United States Patent [19]

Teeter

[11] Patent Number: 4,936,187

[45] Date of Patent: Jun. 26, 1990

[54] WIRE-FREE ARMING SYSTEM FOR AN AIRCRAFT-DELIVERED BOMB

[75] Inventor: Brent A. Teeter, Ridgecrest, Calif.

[73] Assignee: The United States of America as represented by the Secretary of the Navy, Washington, D.C.

[21] Appl. No.: 341,598

[22] Filed: Apr. 20, 1989

[51] Int. Cl.[5] ..... F42C 15/40

[52] U.S. Cl. ..... 89/1.55; 102/221

[58] Field of Search ..... 89/1.55, 6, 6.5; 102/200, 208, 221, 382

[56] References Cited

U.S. PATENT DOCUMENTS

| | | | |
|---|---|---|---|
| 3,211,057 | 10/1965 | White, Jr. et al. | 102/221 |
| 3,228,337 | 1/1966 | Grantham et al. | 102/221 |
| 3,667,342 | 6/1972 | Warnock et al. | 89/1.55 |
| 4,091,734 | 5/1978 | Redmund et al. | 102/221 |
| 4,567,828 | 2/1986 | Campagnuolo et al. | 102/208 |

*Primary Examiner*—Charles T. Jordan

*Attorney, Agent, or Firm*—Sol Sheinbein; Melvin J. Sliwka

[57] ABSTRACT

A system for wire-free arming of a bomb releasably carried by an aircraft bomb rack includes an emitter circuit mounted on the bomb rack, and an electrical power generator circuit, a detector circuit, and an arming circuit mounted on the bomb. The emitter circuit on the bomb rack is activated when the aircraft pilot releases the bomb. The emitter circuit emits a predetermined transmission of electromagnetic energy, such as an infrared pulse train or a pulsed magnetic field, in the direction of the bomb through the airspace between the aircraft bomb rack and bomb. The electrical power generator circuit on the bomb is activated by release of the bomb for generating electrical power as the released bomb separates from the aircraft bomb rack and producing an output power signal after release of the bomb from the bomb rack. The detector circuit on the bomb is responsive to the output power signal from the generator circuit and to detection of the emitted transmission from the emitter circuit for producing an arming signal. The arming circuit is responsive to the output power signal from the generator circuit and to the arming signal from the detector circuit for producing arming of the bomb.

12 Claims, 6 Drawing Sheets

WIRE-FREE ARMING SYSTEM FOR AN AIRCRAFT-DELIVERED BOMB

BACKGROUND OF THE INVENTION

1. Field of the Invention

The present invention generally relates to aircraft-delivered ordnance and, more particularly, is concerned with a system for wire-free arming of an aircraft-delivered bomb.

2. Description of the Prior Art

The arming of aircraft-delivered ordnance, or bombs, has remained essentially unchanged since its inception in World War II. Basically, arming occurs when an arming wire attached between the aircraft bomb rack and the bomb, pulls a pin from a fuze which will then allow the fuze to arm. The arming wire may also at the same time or separately actuate a mechanism that fires a thermal battery or a mechanism that allows ordnance fins to be deployed. Multiple arming wires may be used to perform the various arming tasks necessary for some present day weapons. Thus, the arming process may be quite complicated.

Typically, the arming wire is attached to the aircraft at the bomb rack. There are several termination points that can be used depending on the actuation force and purpose. One point that can be used is an attachment lug (referred to as a positive arming lug) that will result in the arming wire, or lanyard, always being pulled when the bomb drops away from the rack. Another attachment point is the arming solenoid which allows the pilot to select whether or not the arming wire will be pulled when the bomb drops.

On a typical bomb rack there are three attachment points that can be used for positive arming of the arming wire whereby the wire will always get pulled. Additionally, there are two arming solenoids, located fore and aft, which can be independently selected to release or hold the arming wire. More than one arming wire can be attached to the positive arming lugs but only one wire is terminated by the arming solenoid.

The above-described present method of arming aircraft-delivered ordnance by use of an arming wire connecting the bomb to the aircraft bomb rack has several deficiencies in terms of both reliability and safety. One deficiency is that the arming wire may not be installed correctly so that when the weapon is released, the arming wire does not pull the pin from the fuze. As ordnance becomes more complicated to arm, this deficiency becomes more critical. In several current weapons, for instance, there are three separate arming wires that arm the rocket motor, thermal battery, and tail fuze.

Another deficiency is that material defects in the arming wire or in the ordnance interface to the arming wire may cause the wire to fail before arming occurs. Still another deficiency is that bird strikes or other foreign object collisions may cause arming unintentionally or may break the arming wire, preventing arming from occurring.

A further deficiency is that ordnance may become armed unintentionally. One instance where this can happen is when the bomb release lugs do not completely release the bomb on ejection. Typically when a bomb "hangs up", one lug releases properly but the other lug does not. When this happens, the movement of the bomb itself causes the arming wire to be pulled and thus arm itself. Another instance where unintentional arming of the bomb by the arming wire can occur is when the bomb is accidentally dropped at zero airspeed, such as on an aircraft carrier deck. Still another instance is a midair collision between aircraft which results in pulling of the arming wire and unintentional arming of the bomb. A further instance is an ordnance jettison situation where the pilot desires to drop the bomb without arming it. The arming solenoid does not always release the arming wire. Thus, bombs that are intended to be dropped unarmed are actually armed. As should be readily apparent, these occurrences of unintentional arming are of significant concern to pilots.

Arming wires also are relatively inflexible in communicating arming information to the fuze. Conventional methods of communicating information to the fuze use the two arming wire solenoids on the bomb rack. One solenoid is used to arm or not arm the fuze. The other solenoid is used to open or not open retard fins when used or for tail fuze arming or other uses depending on the bomb involved. In any case, however, there are only two conditions that can be communicated: the arm/no arm condition and a second optional condition.

In view of the many above-described deficiencies arising from currently used arming wires, there is a long-felt need for an alternative approach to arming of aircraft-delivered bombs which will eliminate or avoid these deficiencies.

SUMMARY OF THE INVENTION

The present invention avoids the aforementioned deficiencies and thereby satisfies the long-felt need by providing a system for arming of an aircraft-delivered bomb which is wire-free and eliminates the need for any connection between the aircraft and the bomb. In contrast to prior art use of arming wire, the wire-free arming system of the present invention includes an emitter circuit on the aircraft for producing a predetermined transmission of electromagnetic energy, such as a specially coded pulse train, in the direction of the bomb across airspace between the aircraft and bomb, and detector and arming circuits on the bomb for detecting the transmission and for producing the arming of the bomb.

The present invention provides many advantages and features not available nor obtainable by using the prior arming wiring method. First, arming of the bomb can be accomplished when the bomb is away from the aircraft, thus minimizing the danger to the pilot. This would also allow use by aircraft with internally carried weapons. Second, a more flexible arming operation is provided because different arming pulse trains can be transmitted to each bomb for communicating different modes of operation to the bomb fuze. Third, bomb loading procedures are much simplified because arming wires do not need to be connected. Thus, there is no chance that arming wires would be connected incorrectly or that material defects in the arming wires would be responsible for misarming a bomb. Fourth, there is no possibility that foreign objects would accidentally arm the bomb in flight as well as accidental arming due to bomb hangup on the bomb rack or accidental arming onboard an aircraft carrier if the bomb is dropped at zero airspeed.

Accordingly, the present invention is directed to a system for wire-free arming of a bomb releasably carried by an aircraft. The arming system basically includes an emitter circuit mounted on the aircraft, and a detector circuit and arming circuit mounted on the bomb. The emitter circuit on the aircraft is activated, when the aircraft pilot releases the bomb, for emitting a predetermined transmission of electromagnetic energy, such as an infrared pulse train or a pulsed or static magnetic field, in the direction of the bomb through airspace between the aircraft and bomb. The detector circuit on the bomb is responsive to detection of the emitted transmission from the emitter circuit for producing an arming signal. The arming circuit is responsive to the arming signal from the detector circuit for producing arming of the bomb.

The arming system also preferably includes an electrical power generator circuit mounted on the bomb. The power generator circuit on the bomb is activated by release of the bomb for generating electrical power, as the released bomb separates from the aircraft, and producing an output power signal. The detector circuit on the bomb produces the arming signal in response to the output power signal from the generator circuit in addition to detection of the emitted transmission from the emitter circuit. The arming circuit produces arming of the bomb in response to the output power signal from the generator circuit in addition to the arming signal from the detector circuit.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
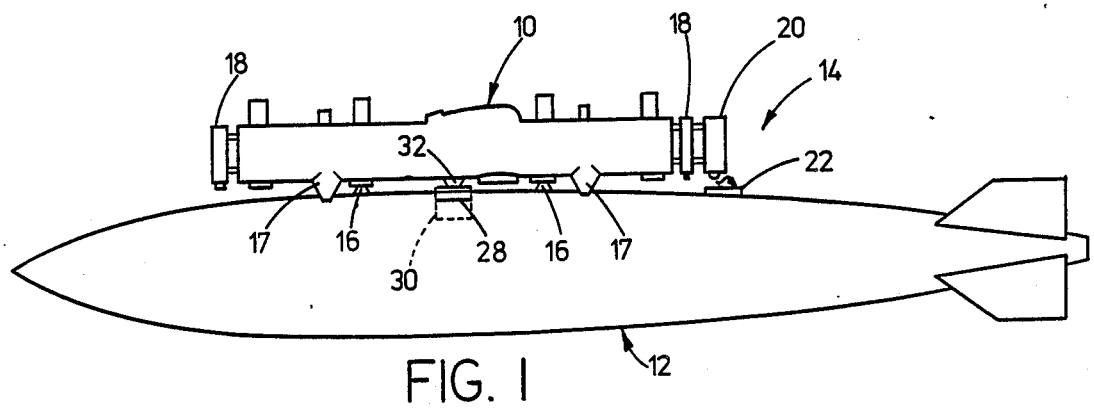
FIG. 1 is a schematical representation of a bomb rack of an aircraft and rack-supported bomb employing a wire-free arming system in accordance with the present invention, with the arming system having emitter and detector circuits employing infrared electromagnetic energy.
Figure 2:
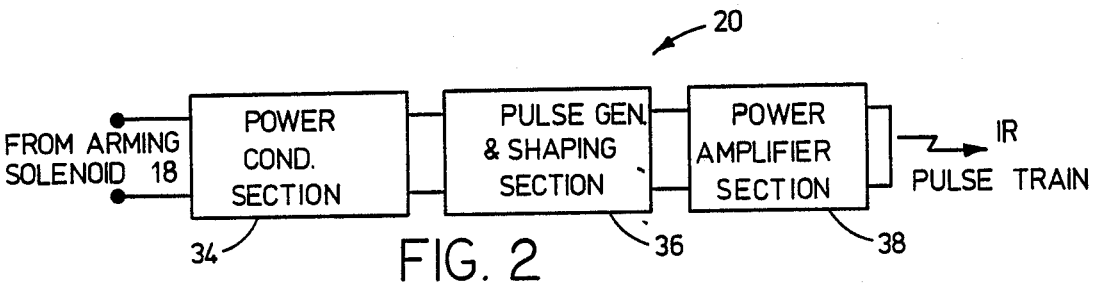
FIG. 2 is a block diagram representation of the emitter circuit of the arming system of FIG. 1.
Figure 3:
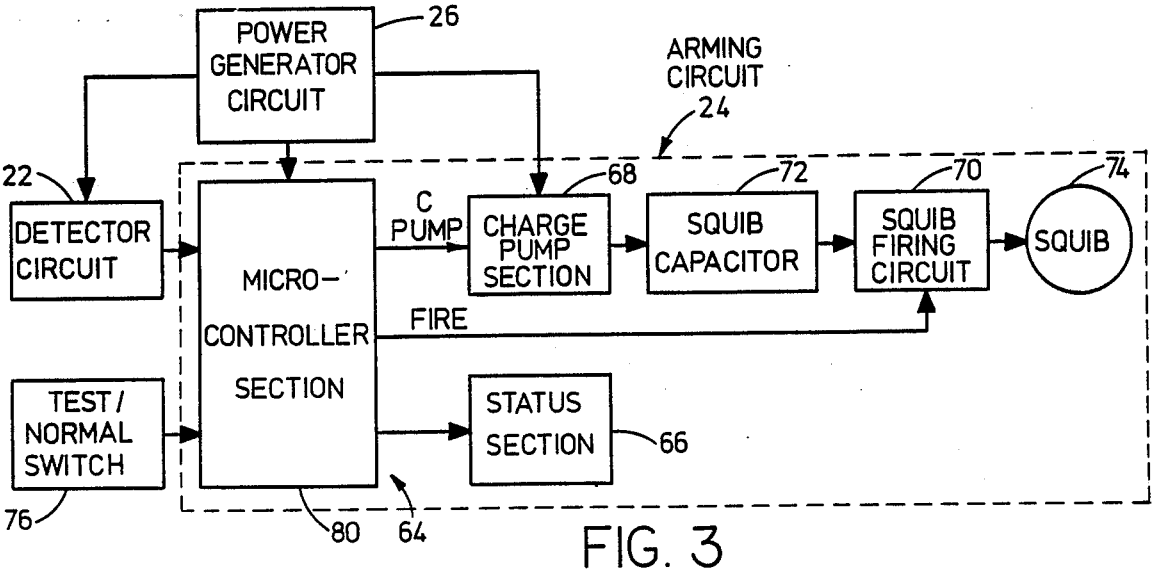
FIG. 3 is a block diagram representation of the electrical power generator circuit, detector circuit and arming circuit of the arming system of FIG. 1.

Referring now to the drawings, and particularly to FIGS. 1–3, there is schematically shown a bomb rack 10 of an aircraft and a bomb 12 releasably carried by the bomb rack 10 which jointly incorporate a wire-free arming system in accordance with the present invention, being identified overall by the numeral 14. The bomb 12 is releasably carried from the bomb rack 10 by fore and aft spaced bomb lugs 16 and sway braces 17 on the rack 10. Also, the bomb rack 10 has fore and aft arming solenoids 18 thereon.

Wire-Free Arming System - In General

In its basic components, the wire-free arming system 14 includes an emitter circuit 20 mounted on the bomb rack 10 and, specifically, coupled in parallel to the aft one of the arming solenoids 18, and a detector circuit 22 and an arming circuit 24 mounted on the bomb 12. In addition, preferably, the arming system 14 includes an electrical power generator circuit 26 mounted on the bomb 12 for powering the detector circuit 22 and the arming circuit 24.

The emitter circuit 20 of the portion of the arming system 14 on the bomb rack 10 is activated when the aircraft pilot releases the bomb 12 by moving a master arming switch in the cockpit to the arm position. Upon being activated, the emitter circuit 20 emits a predetermined transmission of electromagnetic energy in the direction of the bomb 12 through airspace between the bomb rack 10 and bomb 12.

The electrical power generator circuit 26 of the portion of the arming system 14 on the bomb is activated by release of the bomb 12 for generating electrical power as the released bomb 12 separates from the aircraft bomb rack 10. The generation of electrical power by the power generator circuit 26, after release of the bomb 12, produces an output power signal for powering the detector circuit 22 and arming circuit 24. Preferably, the power generator circuit 26 employs a ram air generator 28 which fits into a fuze well 30 in the bomb 12 that is open at the upper side of the bomb 12 and spaced midway between the bomb lugs 16. The generator 28 produces power by extending into and extracting energy from the air stream flow about the bomb 12 as it drops away from the bomb rack 10. The generator 28 does not produce electrical power while the bomb is on the aircraft bomb rack 10 since the generator 28 is prevented from extending into the air stream due to mechanical interference at 32 with the bomb rack 10. Thus, preferably, the bomb 12 does not contain any stored energy that can power the arming circuit 24 prior to release of the bomb.

The detector circuit 22 of the portion of the arming system 14 on the bomb 12 is responsive to the output power signal from the power generator circuit 26 and to detection of the emitted transmission from the emitter circuit 20 for producing an arming signal. Even though emission of the predetermined transmission of electromagnetic energy by the emitter circuit 20 might occur before release of the bomb 12 from the bomb rack 10, actual acquisition of the predetermined transmission is always delayed for a certain minimum period of time, for example 350 ms (milliseconds), after the bomb 12 has been ejected from the rack 10. This delay occurs because the generator 28 does not produce power while the bomb 12 is on the rack 10, as explained above. As will also become clear below, after the detector circuit 22 acquires the transmission and produces the arming signal, there is further delay of time before the arming circuit 24 actually arms the bomb 12. This further time delay is attributable to the time required for charging particular components of the arming circuit 24 which, in turn, are fired to arm the bomb 12. The acquisition and charging time delays allow the separation between the aircraft bomb rack 10 and the bomb 12 to increase, thus, increasing the safety aspects of the arming system 14.

The arming circuit 24 of the portion of the arming system 14 on the bomb 12 is responsive to the output power signal from the power generator circuit 26 and to the arming signal from the detector circuit 22 for producing arming of the bomb 12. The arming circuit 24 will only arm the bomb 12 when a specific transmission, such as an infrared light emitting diode (LED) pulse train, is emitted by the emitter circuit 20. However, by having the detector and arming circuits 22, 24 on the bomb 12 recognize different pulse train patterns, various operating conditions and commands can be communicated to the bomb 12 for carrying out different functions, such as retard/nonretard, fuze arm/safe, contact-/timed burst, etc. Also, specific bombs can be armed while other bombs remain unarmed.

Emitter Circuit of the Arming System

Figure 4:
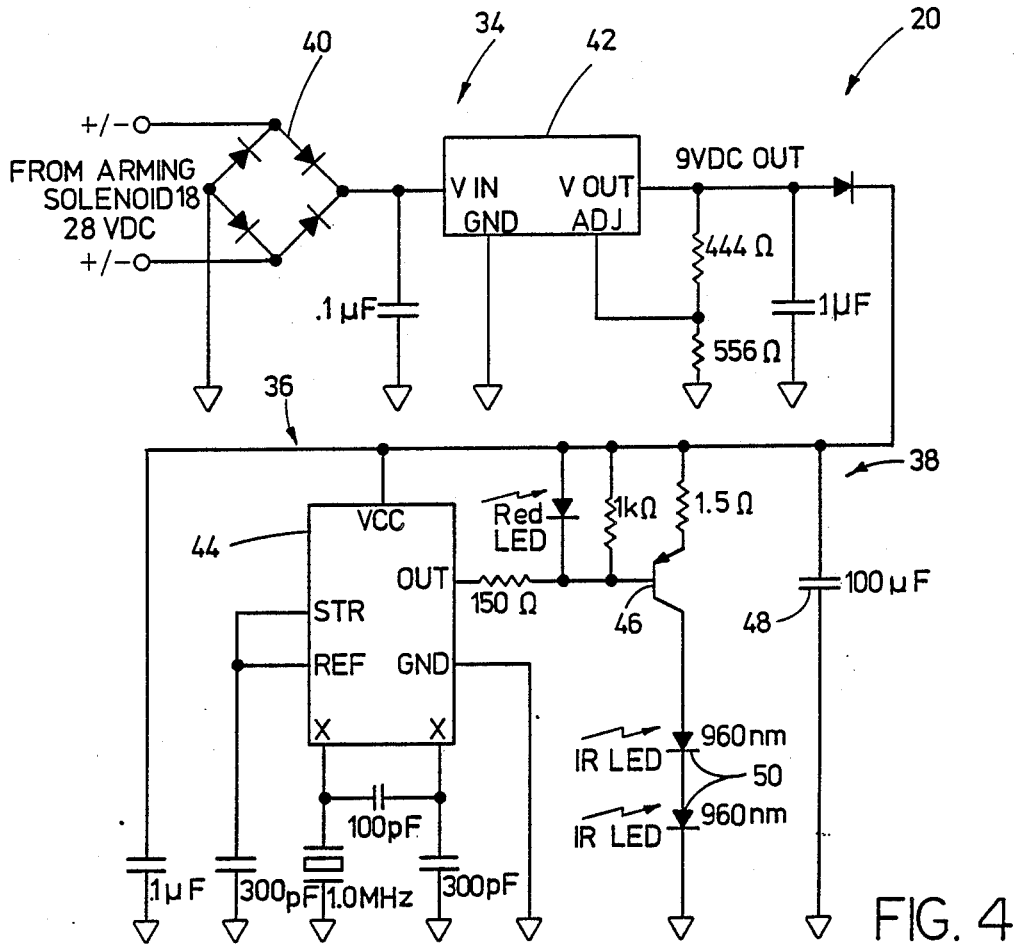
FIG. 4 is a detailed electrical schematic diagram of the emitter circuit of FIG. 2.

The emitter circuit 20 of the wire-free arming system 14 which is attached to the bomb rack 10 is illustrated in a block diagram in FIG. 2 and in a detailed electrical schematic diagram in FIG. 4. The emitter circuit 20 preferably emits a 1.4 ms IR pulse every 45.9 ms when 28 volts DC (VDC) is applied to its inputs. The emitter circuit 20 is connected in parallel with the aft arming solenoid 18. When the solenoid 18 is energized with 28 VDC (armed mode), the infrared LED emitter circuit 20 emits this IR pulse train to the bomb 12 indicating that the bomb is to be armed.

Referring to FIG. 2, the emitter circuit 20 which employs infrared electromagnetic energy includes a power conditioner section 34, a pulse generation and shaping section 36, and a power amplifier-LED section 38. As seen in FIG. 4, the power conditioner section 34 includes a diode bridge rectifier 40 and a 9 VDC voltage regulator (uA78MG) 42. The section 34 protects the emitter circuit 20 from reverse transients present when the aft arming solenoid 18 is turned off, and allows the emitter circuit 20 to be installed (connected) to the solenoid 18 without regard to electrical polarity. The section 34 also converts the 28 VDC to 9 VDC.

The pulse generation and shaping section 36 of the emitter circuit 20 includes a remote control integrated circuit (SN76881) 44 that can output up to thirty-two different pulse patterns, each amplitude modulated, on a 91 KHz carrier. One of the pulse patterns outputted by the section 36 is the 1.4 ms pulse every 45.9 ms which is the predetermined IR pulse transmission. Amplitude modulation is used in order to increase the range and detection reliability of the signal.

The power amplifier-LED section 38 of the emitter circuit 20 includes a transistor amplifier (2N2907) 46 that discharges a capacitor 48 through two infrared emitting LEDs 50. The capacitor 48 charges in time for the next pulse. Each current pulse through the LEDs 50 is approximately 1.0 amp. The spectral distribution of the light emitted by the LEDs 50 is from 875 nm (nanometers) to 1021 nm. The spectral peak of the LEDs 50 is at 960 nm. This emitter circuit 20 can transmit arming information over distances greater than forty feet. Optimal operational utility can be enhanced through the proper selection of wavelength.

Detector Circuit of the Arming System

Figure 5:
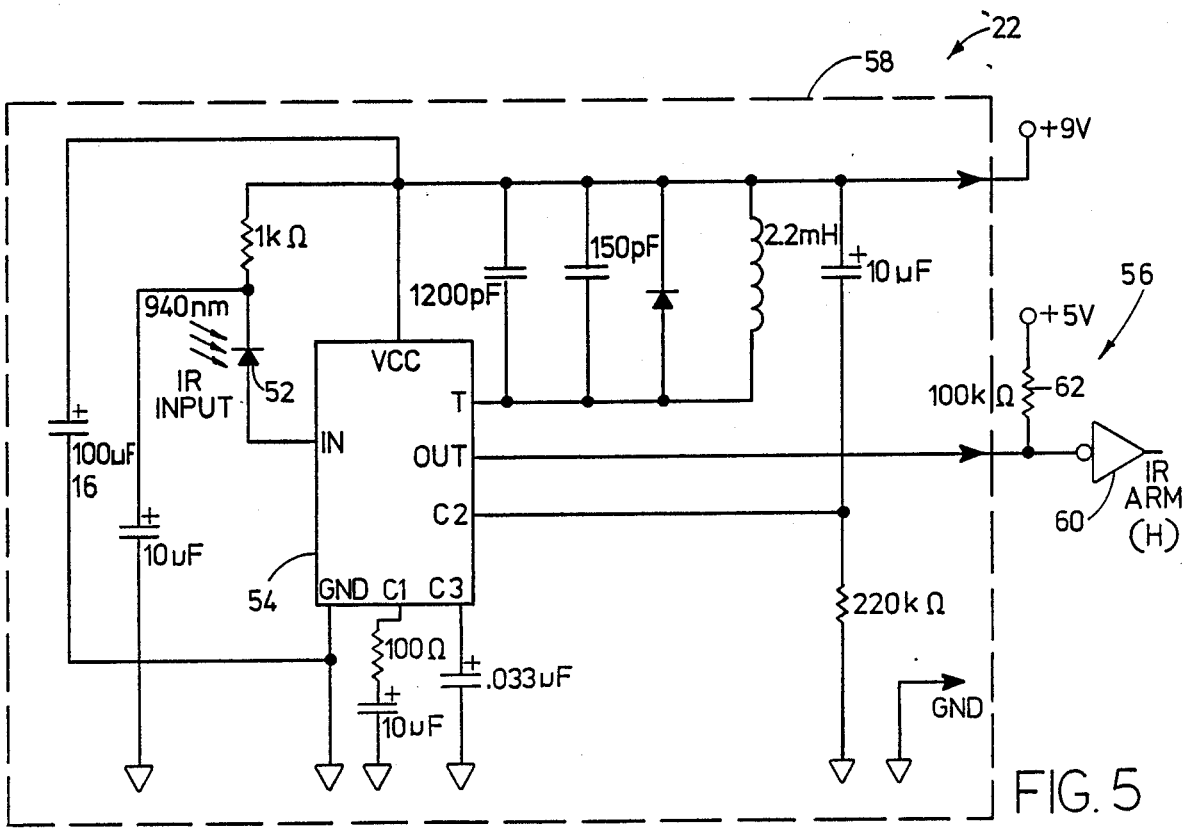
FIG. 5 is a detailed electrical schematic diagram of the detector circuit of FIG. 3.

The detector circuit 22 of the wire-free arming system 14 which is attached to the bomb 12 is depicted in a block diagram in FIG. 3 and in a detailed electrical schematic diagram in FIG. 5. The detector circuit 22 is positioned on the bomb 12 to receive and detect IR pulses in the predetermined transmission from the infrared LED emitter circuit 20 on the bomb rack 10. As seen in FIG. 5, the detector circuit 22 includes a photodiode (PH302) 52 sensitive to 940 nm wavelength infrared light, a preamplifier section (NEC PC1373H) 54, and signal conditioning section 56.

Both the photodiode 52 and preamplifier section 54 of the detector circuit 22 are mounted together in a shielded box, as represented by the dashed rectangle 58 in FIG. 5, positioned on the surface of the bomb 12. Shielding is necessary because the preamplifier section 54 is very sensitive to noise from the photodiode 52. The photodiode 52 is sensitive to light from 700 nm to 1100 nm. It has an integral infrared filter on its surface so that only light within this range is detected. Its radiant sensitive area is 9 square mm. The preamplifier section 54 employs a single integrated circuit optimized for infrared remote control applications. It consists of a photodiode input amplifier with bias level feedback in order to keep the output of the amplifier from being saturated in bright light, a pulse limiter and level shifter, a peak detector to detect the incoming 91 KHz amplitude modulated signal, and a waveform shaper to reduce noise on the detected signal. The preamplifier 54 operates on power supplies from 6 to 14 volts.

Figure 6:
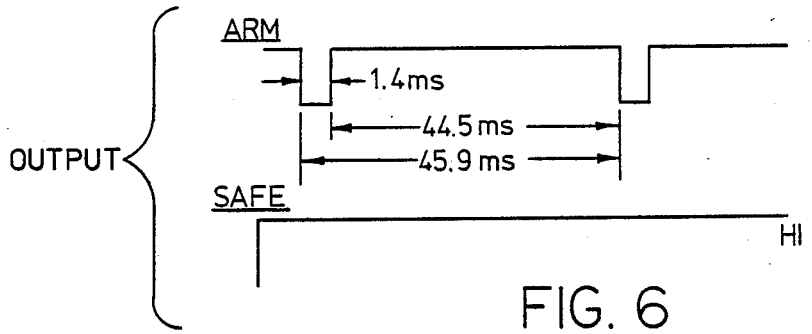
FIG. 6 is a diagram depicting the waveforms of the possible outputs of the detector circuit of FIG. 5.

The signal conditioning section 56 of the detector circuit 22 passes the detected waveform through a Schmitt trigger gate (74C14) 60 with hysteresis in order to further reduce noise on the signal. There is also a pull-up resistor 62 placed on the input to the Schmitt trigger gate 60 so that when the IR detector circuit 22 is disconnected, its arming signal output to the arming section 24 is deasserted (held low). Referring to FIG. 6 as well as FIG. 5, an ARM command (the predetermined pulse train transmission) transmitted by the infrared LED emitter circuit 20 results in a positive-going 1.4 ms pulse with a period of 45.9 ms at the output of the Schmitt trigger gate 60 which is the output of the detector circuit 22. On the other hand, a SAFE command transmitted by the emitter circuit 20 results in a static low level at the output of the Schmitt trigger gate 60 and, thus, of the detector circuit 22. If the IR pulse detector circuit 22 is accidentally disconnected from the arming system 14, no arming commands will reach the arming circuit 24 and it will thus automatically safe the bomb 12.

Arming Circuit of the Arming System

Figure 7:
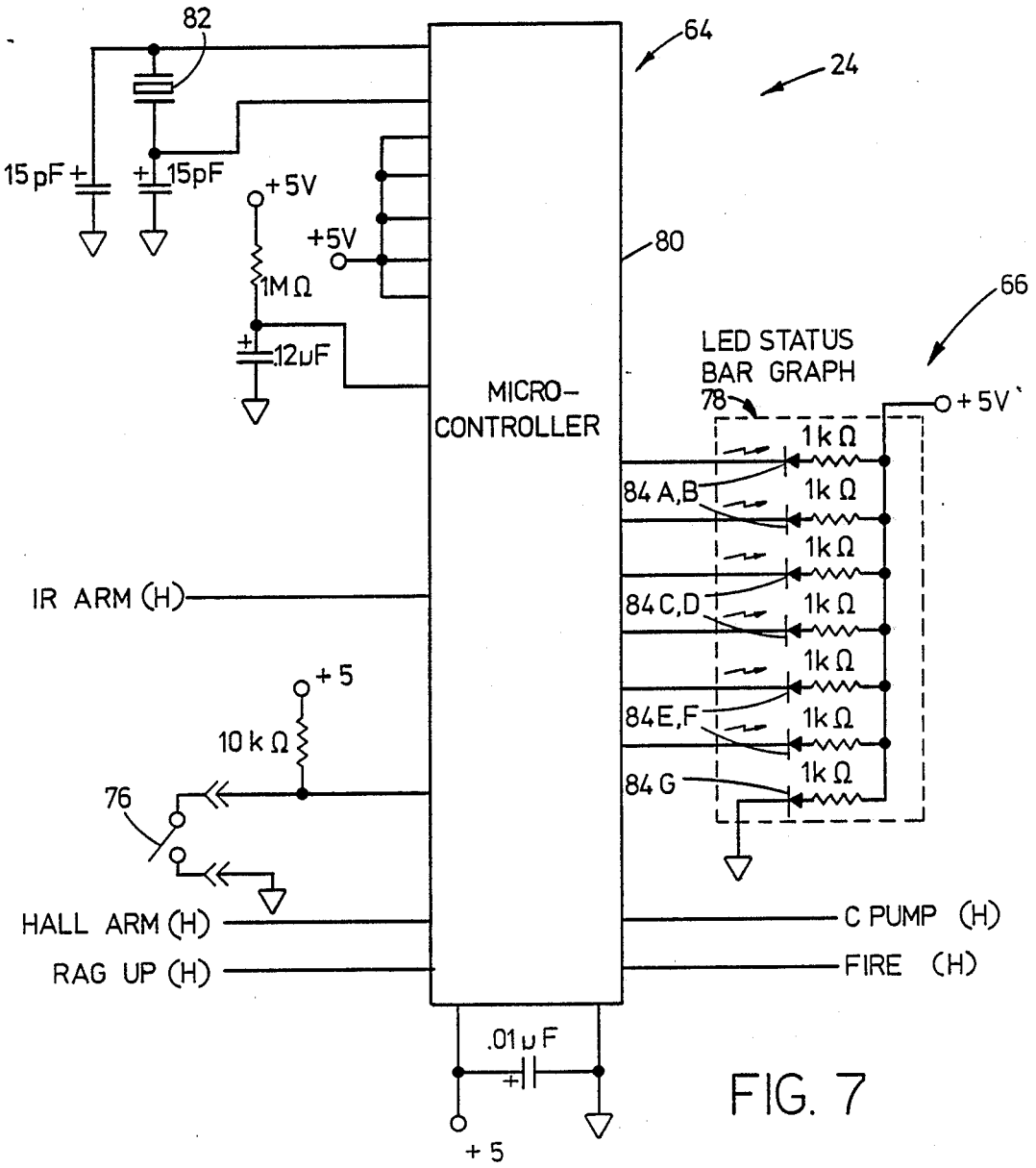
FIG. 7 is a detailed electrical schematic diagram of the microcontroller and status sections of the arming circuit of FIG. 3.
Figure 8:
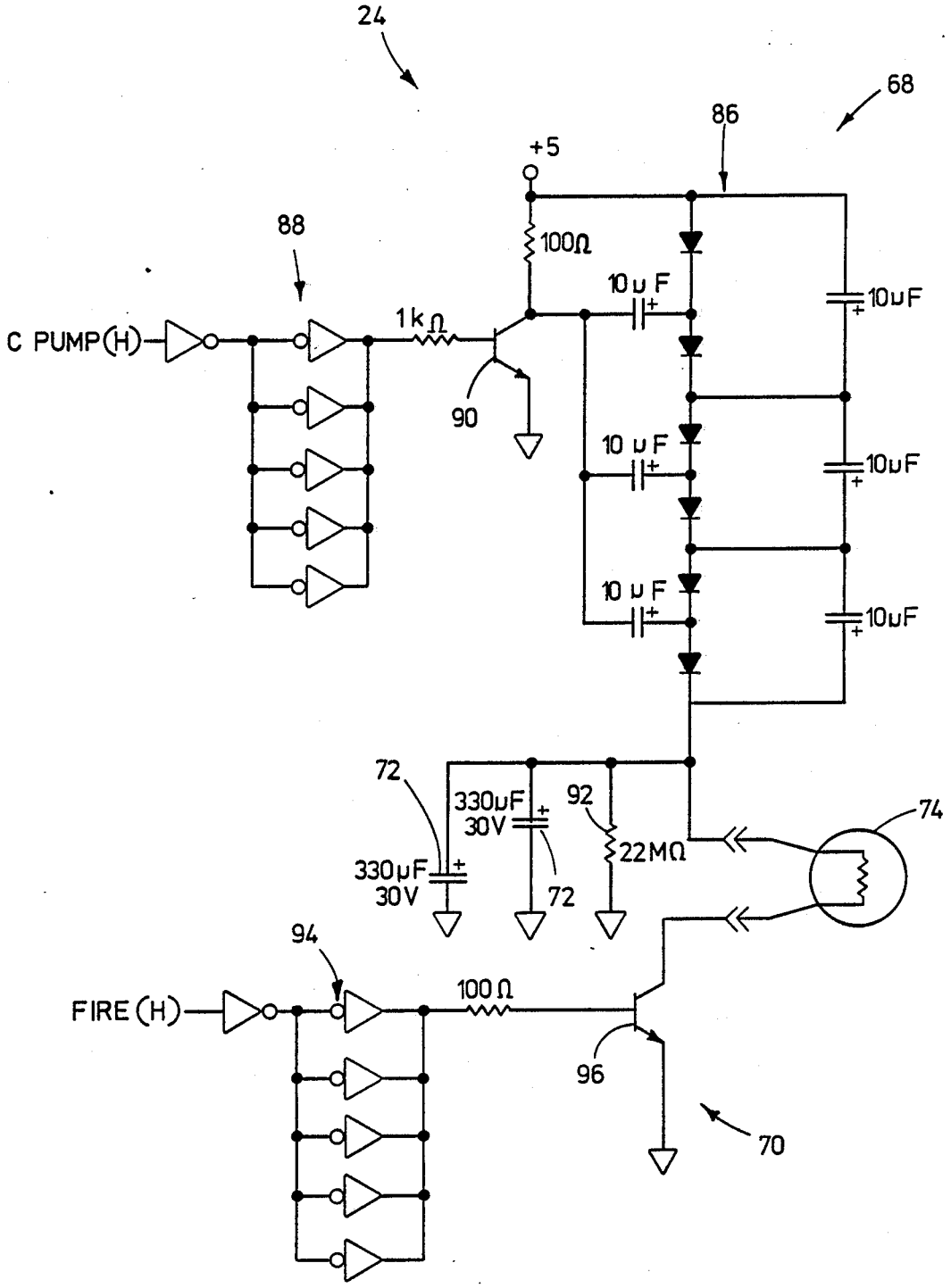
FIG. 8 is a detailed electrical schematic diagram of the charge pump and squib firing sections of the arming circuit of FIG. 3.

The arming circuit 24 of the wire-free arming system 14 which is contained within the the bomb 12 is shown in a block diagram in FIG. 3 and in a detailed electrical schematic diagram in FIGS. 7 and 8. The arming circuit 24 is composed of four sections, the microcontroller section 64 and status section 66 of FIGS. 3 and 7 and the charge pump section 68 and squib firing section 70 of FIGS. 3 and 8.

The arming process is controlled by the microcontroller section 64 that receives data input from the ram air generator 28 of the power generator circuit 26 (air speed determination) and arming information (arming signal) from the IR pulse detector circuit 22. The microcontroller section 64 derives its power from the generator 28 of the power generator circuit 26 as will be described later. The generator 28 also provides power to charge the squib capacitors 72 of the charge pump section 68.

When the microcontroller section 64 receives a valid arming signal from the detector circuit 22, after bomb separation, it activates the charge pump section 68 to charge the squib capacitors 72 and then discharges them through the squib firing section 70 into a squib 74. A mode switch 76 (having modes: test=off, high, open, and normal=on, low, closed) allows circuitry to be tested for proper operation and the output of a test LED status bar graph 78 of the status section 66 shows arming progress and results as the microcontroller section 64 completes each arming task.

Referring to FIG. 7, the microcontroller section 64 uses a 8-bit single chip microcontroller 80 (Hitachi HD63701XOP CMOS UV-EPROM). The microcontroller 80 includes a read only memory (ROM), random access memory (RAM), and input and output lines. It has programmable timers with timing and pulse relationship circuitry. The microcontroller 80 operates at 4.0 MHz supplied by a crystal 82 and starts executing instructions approximately 30 ms after power is applied to it. The microcontroller 80 requires that the reset line be held low for at least 20 ms after power is applied to the controller. The internal timer clock rate is equal to the system clock frequency (4.0 MHz) divided by four. Thus, the timer period is 1 microsecond.

The mode switch 76 connected to one input line is read by the microcontroller 80 to determine whether the mode of the arming circuit 24 is test mode or normal operation mode. In test mode, the microcontroller 80 turns on sequentially each LED 84 of the LED status bar graph 78 of the status section 66, activates the charge pump section 68, and then discharges the squib capacitors 72 through a squib 74 in the squib firing section 70. This mode verifies that the arming system 14 is in operating condition.

The LED status bar graph 78 of the status section 66 consists of seven LEDs 84 connected to an output port of the microcontroller 80. The LEDs 84 are used for debug/test purposes. The meaning of each LED 84A–G when turned on (lighted) is as follows. The Arming Signal Active LED 84A is turned on when an arming signal is being received; whereas when the arming signal is not being received, the LED 84A is turned off. The Ram Air Generator Power Up LED 84B is turned on when the output RAG UP (H) of the power generator circuit 26 exceeds a preset voltage. The Arming Signal Acquired LED 84C is turned on when the microcontroller 80 has determined that it has received a valid arming signal IR ARM (H) from the aircraft. The Charge Pump Started LED 84D is turned on when the microcontroller 80 has activated the charge pump section 68 of the arming circuit 24. The Squib Fired LED 84E is turned on when the squib capacitors 72 are discharged into the squib 74. This LED is used to provide visual indication of firing the squib 74. The Bomb Disarmed LED 84F is turned on if the microcontroller 80 does not receive a valid arming signal within a preset time, in this case, 15 seconds. After this LED is turned on, the microcontroller 80 duds the bomb 12. The 5 Volt DC On LED 84G is on whenever 5 volts is present on the power bus.

The microcontroller 80 is configured so that the output compare register of timer one (a 16 bit timer) is connected to the clock input of timer two (an 8 bit timer). This allows the period of very long pulses to be measured.

The IR pulse detector circuit 22 inputs the signal IR ARM (H) to the microcontroller 80 which is the arming signal. The detector circuit 22 is connected to the timer-one clock input of the microcontroller 80 so that infrared pulse intervals can be measured. This connection is necessary because the arming signal is a pulse width variable signal.

The power generator circuit 26 not only provides the 5 VDC power supply to the arming circuit 24, it also inputs the signal RAG UP (H) to the microcontroller 80 that is asserted (high) when the output of the ram air generator 28 employed by the power generator circuit 26 exceeds a preset voltage. The meaning of this signal will be explained later.

The microcontroller section 64 of the arming circuit 24 drives two output signals from an output port: a charge pump activation drive signal C PUMP (H) and a squib fire command signal FIRE (H). The charge pump activation drive signal is pulsed to the charge pump section 68 by the microcontroller section 64 at approximately 1 KHz for three seconds to provide the pumping action necessary to pump the squib capacitors 72 up to 18 volts. The second output signal, the squib fire command signal FIRE (H), is controlled by the software. It is asserted (high) in order to fire the squib 74 in the squib firing section 70. Specifically, the squib firing signal is used to discharge the squib capacitors 72 into the squib 74 so that the arming process can be completed.

Referring to FIGS. 3 and 8, there is seen the charge pump section 68 and squib firing section 70 of the arming circuit 24 respectively in block diagrams and detailed electrical circuit diagrams. The charge pump section 68, the squib capacitors 72 and the squib firing section 70 are serially connected to one another in that order. The charge pump section 68 and squib firing section 70 are each connected to output ports of the microcontroller section 64 as mentioned above.

After the microcontroller 80 has determined that the bomb 12 shall be armed, it initializes its hardware so that a 50% duty cycle 1 KHz square wave is outputted to the charge pump section 68 for 3.0 seconds. This signal C PUMP (H) provides the oscillation necessary for the charge pump section 68 to move charge across a diode/capacitor ladder 86 therein to higher voltage. The charge pump section 68 also includes a group of Schmitt trigger gates (74C14) 88 connected in parallel which amplify the signal C PUMP (H) and a transistor (2N2222) 90 which amplifies the signal again. Thus, with each oscillation cycle a packet of charge is moved across the diode/capacitor ladder 86 in much the same way that a water pump moves water from one pressure to a higher pressure.

As charge exits the charge pump section 68, it gets deposited into the two 330 microfarad squib capacitors 72. In about 3 seconds, the voltage on the squib capacitors 72 will reach about 18 volts. This is the voltage that will ensure that the squib 74 of the squib firing section 70 will be fired. A dud discharge resistor 92 is provided in order to discharge the squib capacitors 72 if the bomb duds. It has a 4 hour time constant. Thus, the squib capacitors 72 will be 99% discharged in 20 hours.

The firing signal FIRE (H) received by the squib firing section 70 of the arming circuit 24 is asserted (activated) by the microcontroller 80 after the squib capacitors 72 have been charged by the charge pump section 68. The squib firing section 70 includes a group of Schmitt trigger gates (74C14) 94 connected in parallel which amplify the firing signal and a transistor (2N2222) 96 which amplifies the signal again. The transistor 96 discharges the squib capacitors 72 through the squib 74 to electrical ground.

Power Generator Circuit of the Arming System

Figure 9:
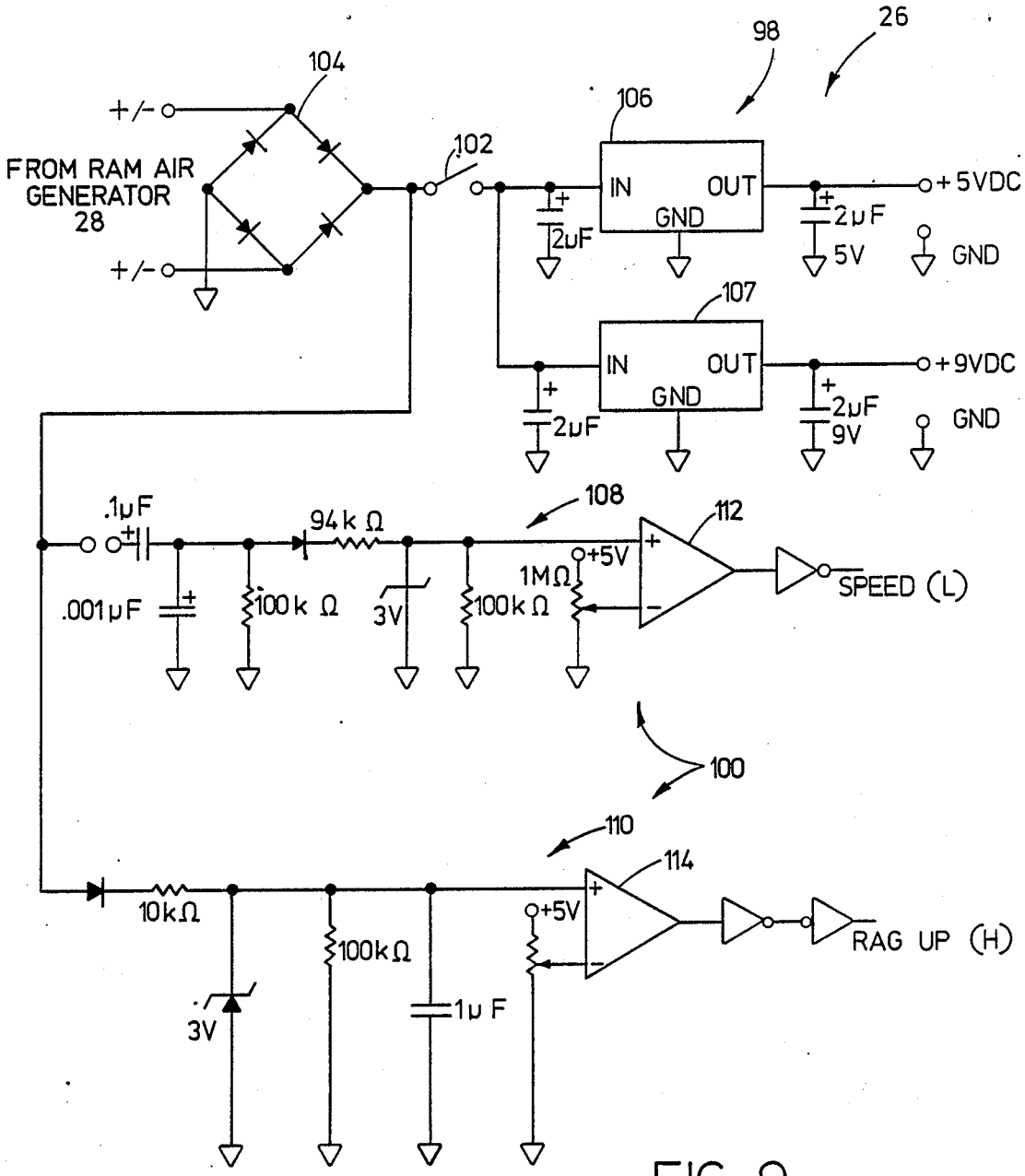
FIG. 9 is a detailed electrical schematic diagram of the electrical power generator circuit of FIG. 3.

The power generator circuit 26 of the wire-free arming system 14 which is contained in the bomb 12 is depicted in a block diagram in FIG. 3 and in a detailed electrical schematic diagram in FIG. 9. The power generator circuit 26 provides +9 VDC and +5 VDC to respectively operate the detector circuit 22 and arming circuit 24. The circuit 26 also provides information on bomb velocity to the microcontroller 80.

Referring to FIG. 9, the power generator circuit 26 includes the ram air generator (FZU-48B) 28, a power conditioning section 98, and a speed determination section 100. As described earlier, the ram air generator 28 is a generator/turbine subassembly that hinges out of the fuze well 30 of the bomb 12 into the airstream. An interlock power switch 102 is provided to prevent power from being applied to the output leads until the generator/turbine is fully extended. Preferably, the ram air generator 28 is spring loaded so that it will open when the bomb 12 is ejected from the bomb rack 10. An interlock pin (not shown) keeps the generator 28 from extending during storage and loading. The generator 28 is held closed by mechanical interference at 32 with the bomb rack 10 when the bomb 12 is loaded on the bomb rack 10 and the interlock pin is removed. The ram air generator 28 has a very short (5 minute total run time) lifetime.

The output of the ram air generator 28 is a half wave rectified sinusoidal AC signal. Since the generator 28 has six poles, there will be three cycles of output per revolution. Thus, by measuring frequency of power output, the rotational speed can be determined. Then, by calibrating rotational speed of the turbine with air speed, the bomb s velocity can be determined.

The power produced by the ram air generator 28 is conditioned by the power conditioning section 98 before being used by the detector circuit 22 and arming circuit 24. The power conditioning section 98 of the power generator circuit 26 includes a diode rectifier bridge (1N645×4) 104 connected to the ram air generator 28 and 5 and 9 VDC voltage regulators 106, 107 connected in parallel with the diode rectifier bridge 104 via the switch 102. The rectifier bridge 104 full wave rectifies power from the generator 28 and supplies it to the parallel voltage regulators 106, 107 and the speed determination section 100. Thus, any positive or negative voltage transients that occur from the generator 28 will be converted to positive transients and filtered. The rectifier bridge 104 also allows the ram air generator 28 to be connected to the power supply section without regard to polarity.

The speed determination section 100 of the power generator circuit 26 includes a conversion portion 108 that converts a variable DC pulsing signal to digital pulses that represent bomb speed, and a threshold portion 110 that outputs an asserted level signal RAG UP (H) when the ram air generator output reaches a predetermined threshold. The conversion portion 108 is used by the microcontroller section 64 to determine the speed of the bomb 12 while the threshold portion 110 provides a simple level that specifies when a specified voltage (i.e., bomb velocity) is reached.

The conversion portion 108 of the speed determination section 100 (the use of which is optional) includes capacitors to subtract the DC component of the ram air generator output, a comparator (LM324) 112, and a noise filter, rectifier, and clipper that prevents inputs to the comparator 112 from going above 3 volts. The resultant pulsed waveform, with a frequency equal to the ram air generator speed, is compared by the comparator 112 to a level set by a potentiometer. The comparing is performed to minimize the effects of noise and the variable output of the ram air generator 28 on the output signal. The output SPEED (L) of the comparator 112 is fed to the microcontroller 80.

The threshold portion 110 of the speed determination section 100 includes a comparator (LM324) 114 and a rectifying diode, capacitor, bleed resistor and clipper. The threshold portion 110 converts the pulsing DC voltage into a level that can be compared by the comparator 114. The rectifying diode allows the capacitor to be charged on the positive voltage cycle and not be discharged except through the bleed off resistor. The zener diode or clipper prevents the input to the comparator 114 from exceeding three volts. The threshold level is set by the potentiometer at one of the inputs of the comparator 114. Noise on the output of the comparator 114 is removed by using a Schmitt trigger gate. The signal RAG UP (H) then passes to the microcontroller section 64.

Software of the Arming System

Figure 10:
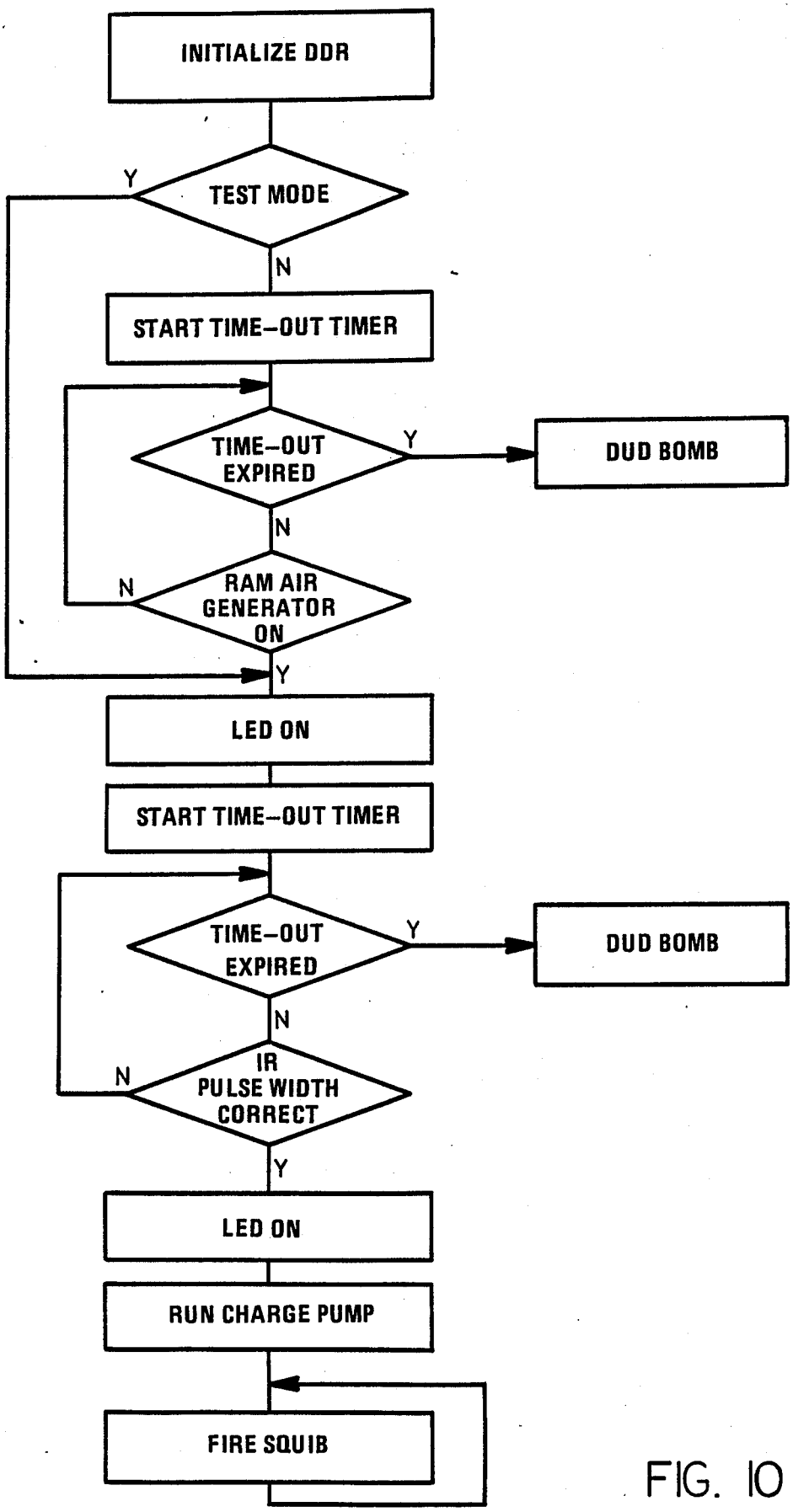
FIG. 10 is a flow chart illustrating, in shorthand form, a program for directing the operation of the microcontroller section of the arming circuit.

FIG. 10 illustrates a flow chart of the program installed in the microcontroller section 64 of the arming circuit 24. The purpose of the program is to control the microcontroller 80 so that it correctly arms a bomb 12 only when conditions warrant the arming to occur. It should be mentioned here that the use of a microcontroller in actual practice of the invention is not necessary. A dedicated logic circuit with the program embedded therein could be used instead.

The program depicted by the flow chart is designed for test purposes and would be similar but not identical to the program that would be used in production. The program contains codes for the LED status bar graph of the arming circuit status section 66 and for debugging and test. As designed, with the mode switch 76 in NORMAL mode, the program will arm the bomb 12 if it receives a valid arming signal from the infrared emitter circuit 20 on the bomb rack 10.

The letters A to J in the blocks of the flow chart in FIG. 10 represent the following activities or decisions of the program: A-Initialized DDR, stack pointer, registers, disable interrupts; B - Is unit in test mode?; C - Start time-out timer ticking; D - Time-out expired?; E - Dud bomb, turn dud LED on; F - Ram air generator up yet?; G Turn status LED on; H-Infrared pulse width right?; I - Run charge pump for 3 seconds; and J - Fire Squib.

When the bomb 12 is dropped, as explained earlier there is at first no energy stored on board to power the bomb arming circuit 24. As the bomb 12 leaves the bomb rack 10, the ram air generator 28 opens and starts to produce power. The microcontroller 80 waits for the power generator circuit threshold portion 110 to indicate that the ram air generator 28 has started to output voltage above the threshold set by the potentiometer therein. This threshold must be crossed within 15 seconds from power on or else the microcontroller 80 will dud the bomb 12.

Once the ram air generator 28 starts producing power above the threshold, the microcontroller 80 looks for a valid arming signal being received by the detector circuit 22 from the emitter circuit 20. A valid arming signal is a 1.4 ms pulse occurring every 45.9 ms. If a valid arming signal is received within 3 seconds of the ram air generator 28 producing power (generator output crossing the threshold), the microcontroller 80 activates the charge pump section 68 for 3 seconds and then discharges the squib capacitors 72 through the squib 74. If the microcontroller 80 does not receive a valid arming signal within 3 seconds of ram air generator power up, then the bomb 12 is dudded.

If the mode switch 76 is placed in TEST mode, the microcontroller 80 sequentially turns on each LED status bar graph LED 84A–G, activates the charge pump section 68 for 3 seconds, and then discharges the squib capacitors 72 into the squib 74. The first LED status bar graph LED 84A, ARMING SIGNAL ACTIVE, is used for arming signal debug. It is turned on by the microcontroller 80 whenever an arming signal is being received and off when the arming signal is not being received. This on/off process occurs in real time. Thus, it is useful in order to determine infrared emitter field of view, etc.

Alternatives

Figure 12:
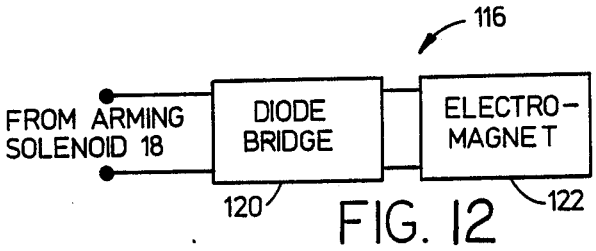
FIG. 12 is a block diagram representation of the emitter circuit of the arming system of FIG. 11.
Figure 11:
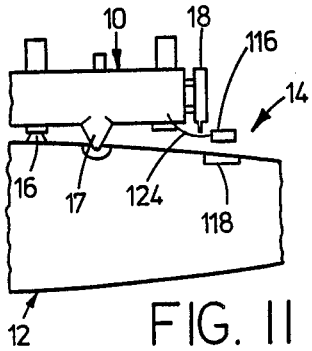
FIG. 11 is a schematical representation similar to that of FIG. 1, but in fragmentary form and with the arming system having, as an alternative, emitter and detector circuits employing Hall effect magnetic field principles.

An advantageous feature of the present invention is that the arming circuit 24 provides a standardized arming architecture such that arming devices other than infrared may be connected to the microcontroller 80 without changing the fundamental design of the arming circuit 24. For example, as shown in FIGS. 11 and 12, an emitter circuit 116 and detector circuit 118 employing a Hall effect magnetic field is used in place of the infrared emitter and detecter circuits 20, 22. The same standardized arming architecture of the arming circuit 24 and the same power generator circuit 26 is employed with the Hall effect emitter and detector circuits 116, 118.

More particularly, the Hall effect emitter circuit 116 which is attached to the bomb rack 10 includes a diode bridge rectifier 120 and an electromagnet 122. The electromagnet 122 is attached via a tether 124 to the bomb rack 10. The electromagnet 122 is connected in parallel with the rectifier 120 which, in turn, is connected in parallel with the aft arming solenoid 18, and produces a magnetic field whenever the arming solenoid is energized. The rectifier 120 guarantees that current will always flow through the electromagnet 122 in the same direction, thus always creating the magnetic field in the same direction. Since the Hall effect detector circuit 118 will only detect a magnetic field flowing from the south pole of a magnet, the bomb will only arm if the magnetic field is flowing in the proper direction. The electromagnet 122 has a coil resistance of 68 ohms and operates on 28 VDC; thus, it has the same characteristics as arming solenoid 18 on the bomb rack 10. When energized, the electromagnet 122 produces a magnetic field in excess of 300 gauss over the face of its poles. This field intensity is more than adequate to trigger the Hall effect detector circuit 118 rated at 90 gauss.

The Hall effect detector circuit 118 is mounted externally on the bomb 12 close to the aft bomb lug 16 and sway brace 17 but beneath the aft arming solenoid 18. It is mounted so that the magnetic flux created by the electromagnet 122 passes through the detector circuit 118. The electromagnet 122 is located so that its poles are within one inch of the Hall effect detector circuit 118. As stated above, the Hall effect detector circuit 118 requires a magnetic flux density of at least 90 gauss in order to output an asserted signal.

The Hall effect detector circuit 118 thus senses the presence or absence of the magnetic field produced by the electromagnet 122 and appropriately arms or duds the bomb 12. The same arming circuit 24 on the bomb 12 is powered using the same ram air generator 28, as in the arming system using infrared electromagnetic energy. Also, the same type of program is used by both the infrared and Hall effect arming alternatives.

When the bomb 12 is dropped, the electromagnet 122 travels down with the bomb for about six feet or for 500 ms and then is pulled away from the bomb 12. During this time, the generator 28 begins producing power and the microcontroller 80 starts executing its program. The program first checks to see if the bomb velocity is within limits (bomb velocity is determined by generator output frequency) and it then checks to see if the Hall effect detector circuit 118 is detecting the presence of a magnetic field. If the detector circuit 118 detects a magnetic field, then the microcontroller 80 charges the squib capacitors 72 for 3 seconds and then discharges them into the squib 74. This charging time allows the separation between the aircraft and the bomb to increase. When the squib 74 is fired, the bomb 12 becomes armed. By pulsing the magnetic field and having the microcontroller recognize these pulses, various other conditions and commands can be transmitted to the bomb, the same as in the case of the IR pulse train.

The use of the Hall effect circuits 116, 118 has several advantages. The Hall effect device is very small, simple, rugged, and low cost. It is currently used in automotive ignition systems where it is subjected to high and low temperatures, high EMI fields, and water and dirt environments. It will detect arming signals reliably under these constraints. Its low cost and flat form factor allow it to be flexibly configured to the bomb. Arming information can be transmitted to it easily. The Hall effect device is also virtually immune to countermeasures, detection of arming from ground observers, and accidental arming (if pulsed magnetic fields are used). It also allows the same advantages as the IR device described earlier because of the elimination of the arming wire.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely a preferred or exemplary embodiment thereof.

Having thus described the invention, what is claimed is:

1. A system for wire-free arming of a bomb releasably carried by an aircraft, said arming system comprising:

means for mounting on the aircraft and for emitting a predetermined transmission of electromagnetic energy through airspace between the aircraft and the bomb;

means for mounting on the bomb and for detecting the emitted predetermined transmission and producing an arming signal in response thereto;

means for mounting on the bomb and being responsive to the arming signal from said detecting means for producing arming of the bomb;

means for mounting on the bomb and being responsive to release of the bomb from the aircraft for generating electrical power and producing an output of said power above a predetermined voltage threshold after release of the bomb from the aircraft;

said detecting means being responsive both to the output power from said power generating means and to detection of the emitted transmission from said emitting means for producing the arming signal;

said arming producing-means being responsive both to the output power from said power generating means and to the arming signal from said detecting means for producing arming of the bomb; and said arming producing-means is operable for arming said bomb if said arming signal is received within a predetermined period of time after said output power is received and for duding said bomb if said arming signal is not received within said predetermined period of time.

2. A system for wire-free arming of a bomb releasably carried by an aircraft, said arming system comprising:

means for mounting on the aircraft and for emitting a predetermined transmission of electromagnetic energy through airspace between the aircraft and bomb;

means for mounting on the bomb and for detecting the emitted predetermined transmission and producing an arming signal in response thereto;

means for mounting on the bomb and being responsive to the arming signal from said detecting means for producing arming of the bomb; and wherein the emitted transmission is a Hall effect magnetic field.

3. A system for wire-free arming of a bomb releasably carried by an aircraft, said arming system comprising:

means for mounting on the aircraft and for emitting a predetermined transmission of electromagnetic energy through airspace between the aircraft and bomb;

means for mounting on the bomb and for detecting the emitted predetermined transmission and producing an arming signal in response thereto;

means for mounting on the bomb and being responsive to the arming signal from said detecting means for producing arming of the bomb; and wherein said emitting means includes an electromagnet for generating a magnetic field adjacent said detecting means.

4. The system as recited in claim 3, wherein said detecting means is a Hall effect device for detecting the magnetic field of said electromagnet and for producing the arming signal in response thereto.

5. A system for wire-free arming of a bomb releasably carried by an aircraft, said arming system comprising:

means for mounting on the aircraft and for emitting a predetermined transmission of electromagnetic energy through airspace between the aircraft and bomb;

means for mounting on the bomb and for detecting the emitted predetermined transmission and producing an arming signal in response thereto;

means for mounting on the bomb and being responsive to the arming signal from said detecting means or producing arming of the bomb;

wherein said arming-producing means includes:

means being activatable for storing an electrical charge and being deactivatable for discharging the stored charge;

means being actuatable for firing and thereby causing arming of the bomb in response to receipt of the stored charge from said storing means; and control means for receiving the detected arming signal from said detecting means and for deciding whether or not the detected arming signal is valid, said control means also being operable for activating said storing means to cause storing of the charge and thereafter for deactivating said storing means to cause discharging of the charge to said firing means in response to a decision that the detected arming signal is valid.

6. In combination with an aircraft and a bomb releasably carried by said aircraft, a system for wire-free arming of said bomb, said arming system comprising:

means mounted on said aircraft for emitting a predetermined transmission of electromagnetic energy through airspace between said aircraft and bomb;

means mounted on said bomb and responsive to release of said bomb from said aircraft for generating electrical power and producing output power above a predetermined voltage threshold after release of said bomb from said aircraft;

means mounted on said bomb for producing an arming signal in response to detecting the emitted predetermined transmission from said emitting means and to receiving said output power from said power generating means;

means mounted on said bomb for producing arming of aid bomb in response to receiving said output power from said power generating means and to receiving the arming signal from said detecting means; and wherein said arming producing-means is operable for arming said bomb if said arming signal is received within a predetermined period of time after said output power is received and for duding said bomb if said arming signal is not received within said predetermined period of time.

7. In combination with an aircraft and a bomb releasably carried by said aircraft, a system a wire-free arming of said bomb, said arming system comprising:

means mounted on said aircraft for emitting a predetermined transmission of electromagnetic energy through airspace between said aircraft and bomb;

means mounted on said bomb and responsive to release of said bomb from said aircraft for generating electrical power and producing output power above a predetermined voltage threshold after release of said bomb from said aircraft;

means mounted on said bomb for producing an arming signal in response to detecting the emitted predetermined transmission from said emitting means and to receiving said output power from said power generating means;

means mounted on said bomb for producing arming of said bomb in response to receiving said output power from said power generating means and to receiving the arming signal from said detecting means; and wherein the emitted transmission is a Hall effect magnetic field.

8. In combination with an aircraft and a bomb releasably carried by said aircraft, a system for wire-free arming of said bomb, said arming system comprising:

means mounted on said aircraft for emitting a predetermined transmission of electromagnetic energy through airspace between said aircraft and bomb;

means mounted on said bomb and responsive to release of said bomb from said aircraft for generating electrical power and producing output power above a predetermined voltage threshold after release of said bomb from said aircraft;

means mounted on said bomb for producing an arming signal in response to detecting the emitted predetermined transmission from said emitting means and to receiving said output power from said power generating means;

means mounted on said bomb for producing arming of said bomb in response to receiving said output power from said power generating means and to receiving the arming signal from said detecting means; and wherein said emitting means includes an electromagnet for generating a magnetic field adjacent said detecting means.

9. The system as recited in claim 8, wherein said detecting means is a Hall effect device for detecting the magnetic field of said electromagnet and for producing the arming signal in response thereto.

10. In combination with an aircraft and a bomb releasably carried by said aircraft, a system for wire-free arming of said bomb, said arming system comprising:

means mounted on said aircraft for emitting a predetermined transmission of electromagnetic energy through airspace between said aircraft and bomb;

means mounted on said bomb and responsive to release of said bomb from said aircraft for generating electrical power and producing output power above a predetermined voltage threshold after release of said bomb from said aircraft;

means mounted on said bomb for producing an arming signal in response to detecting the emitted predetermined transmission from said emitting means and to receiving said output power from said power generating means;

means mounted on said bomb for producing arming of said bomb in response to receiving said output power from said power generating means and to receiving the arming signal from said detecting means; and wherein said arming-producing means includes:

means being activatable for storing an electrical charge and being deactivatable for discharging the stored charge;

means being actuatable for firing and thereby causing arming of the bomb in response to receipt of the stored charge from said storing means; and control means for receiving the detected arming signal from said detecting means and for deciding whether or not the detected arming signal is valid, said control means also being operable for activating said storing means to cause storing of the charge and thereafter for deactivating said storing means to cause discharging of the charge to said firing means in response to a decision that the detected arming signal is valid.

11. A method for wire-free arming of a bomb releasably carried by an aircraft, said arming method comprising the steps of:

emitting a predetermined transmission of electromagnetic energy from the aircraft through the airspace between the aircraft and bomb;

detecting the emitted predetermined transmission and producing an arming signal in response thereto;

producing arming of the bomb in response to detection of the arming signal;

generating electrical power in response to release of the bomb form the aircraft and producing output power above a predetermined voltage threshold after release of the bomb from the aircraft;

said producing of the arming signal being in response to both receiving the output power and detecting the emitted transmission;

said producing of arming of the bomb being in response to both receiving the output power and receiving the arming signal;

and wherein said producing of arming of said bomb occurs if said arming signal is received within a predetermined period of time after said output power is received, whereas producing of duding of said bomb occurs if said arming signal is not received within said predetermined period of time.

12. A method for wire-free arming of a bomb releasably carried by an aircraft, said arming method comprising the steps of:

emitting a predetermined transmission of electromagnetic energy from the aircraft through the airspace between the aircraft and bomb;

detecting the emitted predetermined transmission and producing an arming signal in response thereto;

producing arming of the bomb in response to detecting of the arming signal; and wherein the predetermined transmission emitted and detected is a Hall effect magnetic field.

* * * * *